US008151988B2

(12) United States Patent
Smith et al.

(10) Patent No.: US 8,151,988 B2
(45) **Date of Patent: *Apr. 10, 2012**

(54) DISPLAY PACKAGING SYSTEM

(75) Inventors: Keith Smith, Frankfort, IL (US); James C. Durham, Glenview, IL (US); Scott D. Greiwe, Elmhurst, IL (US)

(73) Assignee: Transparent Container Company, Inc., Addison, IL (US)

( * ) Notice: Subject to any disclaimer, the term of this patent is extended or adjusted under 35 U.S.C. 154(b) by 311 days.

This patent is subject to a terminal disclaimer.

(21) Appl. No.: 12/623,471

(22) Filed: Nov. 23, 2009

(65) Prior Publication Data

US 2010/0126895 A1 May 27, 2010

Related U.S. Application Data

(63) Continuation-in-part of application No. 11/960,082, filed on Dec. 19, 2007, now Pat. No. 7,621,400.

(51) Int. Cl.
*B65D 73/00* (2006.01)

(52) U.S. Cl. ..... 206/462; 206/461

(58) Field of Classification Search ..... 206/461, 206/462, 463, 464, 465, 69, 775, 776, 780, 206/783, 470, 471

See application file for complete search history.

(56) References Cited

U.S. PATENT DOCUMENTS

| | | | | |
|---|---|---|---|---|
| 3,217,871 | A * | 11/1965 | Lee | 206/484.2 |
| 4,083,451 | A * | 4/1978 | Hair | 206/461 |
| 6,691,870 | B1 * | 2/2004 | Palm et al. | 206/462 |
| 7,051,876 | B2 * | 5/2006 | Grosskopf | 206/462 |
| 7,165,676 | B2 * | 1/2007 | Dalessandro | 206/461 |
| 2004/0040880 | A1 * | 3/2004 | Grosskopf | 206/461 |
| 2006/0016717 | A1 * | 1/2006 | Ritter | 206/526 |
| 2006/0091037 | A1 * | 5/2006 | Grote et al. | 206/471 |
| 2007/0114153 | A1 * | 5/2007 | Ritter | 206/462 |
| 2007/0125678 | A1 * | 6/2007 | Green | 206/461 |

* cited by examiner

*Primary Examiner* — Steven A. Reynolds
*Assistant Examiner* — King M Chu
(74) *Attorney, Agent, or Firm* — Greenberg Traurig, LLP

(57) ABSTRACT

A display packaging system includes a front panel, a rear panel, and a blister cavity. The blister cavity has a product holding chamber configured to receive at least one product and a sealing flange that extends outwardly from the product holding chamber. The sealing flange includes a series of apertures and is sandwiched between the interior surface of the front panel and the interior surface of the rear panel. Respective portions of an interior surface of the front panel and an interior surface of the rear panel are then adhered only to each other with the respective portions including portions of the interior surface of the front panel and portions of the interior surface of the rear panel that are disposed on opposite sides of the series of apertures.

19 Claims, 3 Drawing Sheets

DISPLAY PACKAGING SYSTEM

RELATED APPLICATION DATA

This application is a continuation-in-part of U.S. application Ser. No. 11/960,082, filed 19 Dec. 2007, which application is incorporated herein by reference in its entirety.

BACKGROUND

Display packaging systems are known in the art. By way of example, U.S. Published Application No. 2007/0114154 illustrates and describes a display packaging system that incorporates a plastic blister cavity sandwiched between layers of material, such as corrugated paperboard. U.S. Published Application No. 2007/0051652 illustrates and describes methods of sealing a plastic blister cavity between layers of material, such as plasticized or laminated paperboard material, using heat sealing techniques. U.S. Published Application No. 2007/0209957 illustrates and describes a display packaging system particularly suited for packaging medical devices, such as surgical instruments, implants, and prostheses, incorporating a plastic blister cavity positioned between layers of material. U.S. Pat. No. 7,051,876 illustrates and describes a clamshell package having a product holding chamber that is preferably seamless such that it may not be opened without the use of scissors and, when opened, does not form sharp or jagged edges that may pose a danger to anyone handling the package. These published documents are incorporated herein by reference in their entirety.

SUMMARY

A novel display packaging system is hereinafter described. More particularly, the subject display packaging system includes a front panel, a rear panel, and a blister cavity comprising a product holding chamber configured to receive at least one product and a sealing flange that extends outwardly from the product holding chamber. The sealing flange includes a series of apertures and is sandwiched between an interior surface of the front panel and an interior surface of the rear panel. Respective portions of the interior surface of the front panel and the interior surface of the rear panel are adhered only to each other, i.e., the system provides for panel to panel adhesion while avoiding any panel to blister cavity/blister cavity flange adhesion. The adhered portions includes portions of the interior surface of the front panel and portions of the interior surface of the rear panel that are disposed on opposite sides of the series of apertures to thereby secure the blister cavity within the adhered panels while the avoidance of adhesion of any portion of the interior surfaces of the panels to the blister cavity/blister cavity flange thereby allows the blister cavity and the panels to be cleanly separated when the packaging system is later opened.

A better understanding of the objects, advantages, features, properties and relationships of the subject display packaging system will be obtained from the following detailed description and accompanying drawings which set forth an illustrative embodiment and which are indicative of the various ways in which the principles of the invention may be employed.

BRIEF DESCRIPTION OF THE DRAWINGS

For a better understanding of the display packaging systems reference may be had to the following drawings in which.

DETAILED DESCRIPTION

Figure 1:
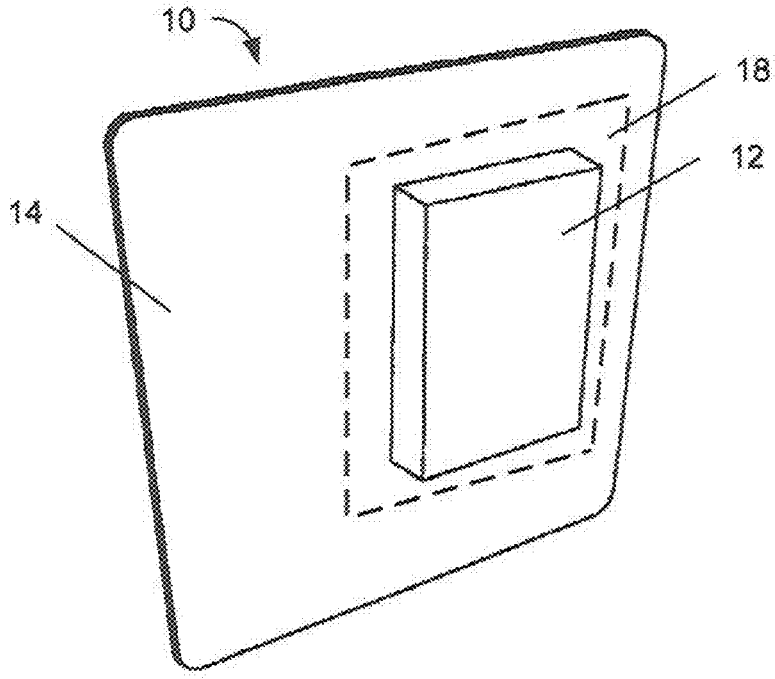
FIG. 1 is a front perspective view showing a first exemplary display packaging system in an assembled state.

Referring now to the figures, the following describes several embodiments of a display packaging system 10. As will be appreciated, a display packaging system 10 generally comprises a blister cavity 12 sandwiched between a front panel 14 and a rear panel 16. The blister cavity 12 may be a thermoformed or similar plastic material including, but not limited to, those selected from the group consisting of polyvinyl chloride (PVC); polyethylene terephthalate (PET); polyethylene teraphthalate glycol (PETG); polylactic acid (PLA); polypropylene (PP); and oriented polystyrene (OPS). The front panel 14 and the rear panel 16 may be constructed from a paperboard material including, but not limited to, those selected from the group consisting of SBS; SBS/recycled paper blends; kraft back board; news back board; box board; container board; microfluted corrugated; and e-flute corrugated. The interior surface of each of the panels 14 and 16 is preferably provided with a heat activated adhesive coating. The exterior surface of one or both of the panels 14 and 16 may be imprinted with various types of graphics, such as product messages, images, instructions, safety information, UPC codes, and the like. The panels 14 and 16 may also include one or more openings to allow the assembled system 10 to be displayed on a pegboard style retail display.

Figure 2:
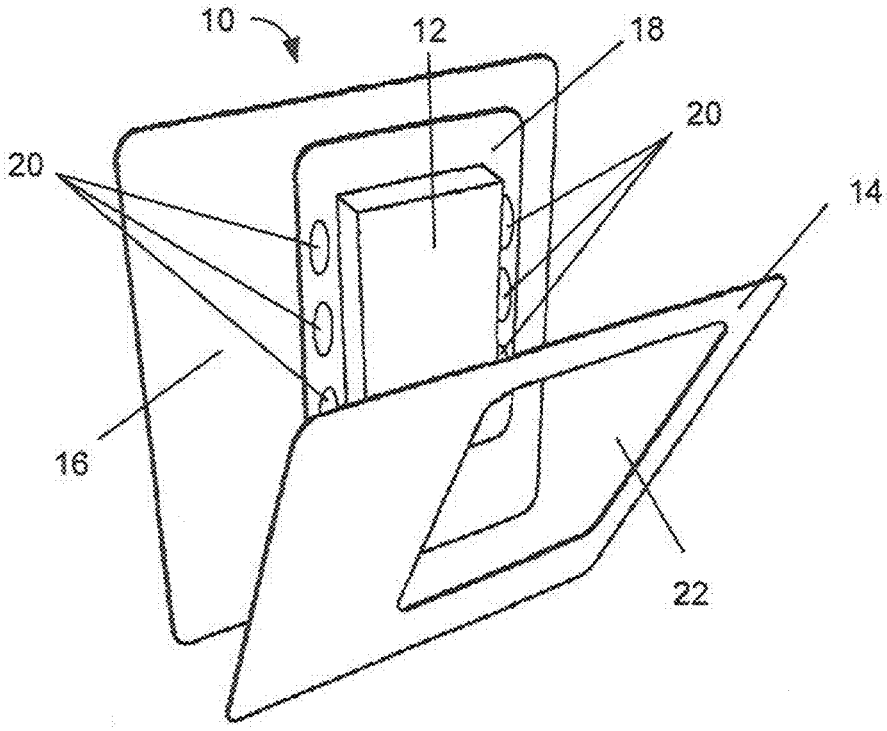
FIG. 2 is a front perspective view showing the exemplary display packaging of FIG. 1 in a partially disassembled state.

As further illustrated in FIG. 2, the blister cavity 12 includes an outwardly extending sealing flange 18. While FIG. 2 illustrates a single sealing flange 18 that extends completely around the periphery of the product holding chamber of the blister cavity 12, it is to be understood that the sealing flange may comprise multiple discrete flanges that extend from discrete locations about the periphery, or portions of the periphery, of the product holding chamber of the blister cavity 12. In either case, the sealing flange 18 is desired to be of sufficient width to allow for the incorporation of a number of or series of intermittent apertures 20. For the sake of clarity, the apertures that are provided to the sealing flange(s) 18 are not shown in FIGS. 1 and 3-6. The apertures 20 may be rounded perforations, elongated slots (i.e., not fully surrounded by sealing flange 18 material), and/or have any desired shape.

Figure 3:
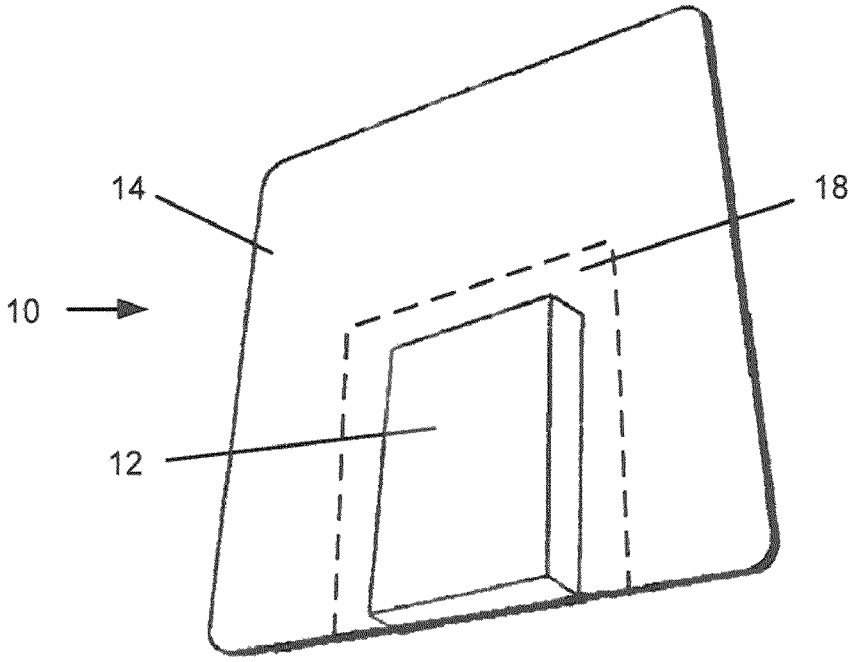
FIG. 3 is a front perspective view showing a second exemplary display packaging system in an assembled state.
Figure 4:
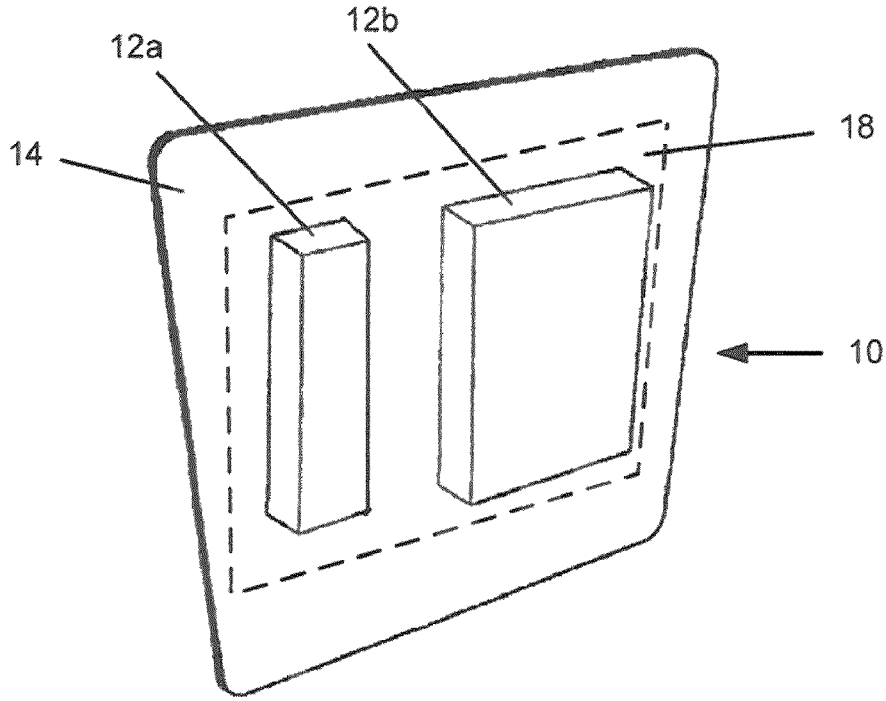
FIG. 4 is a front perspective view showing a third exemplary display packaging system in an assembled state.
Figure 5:
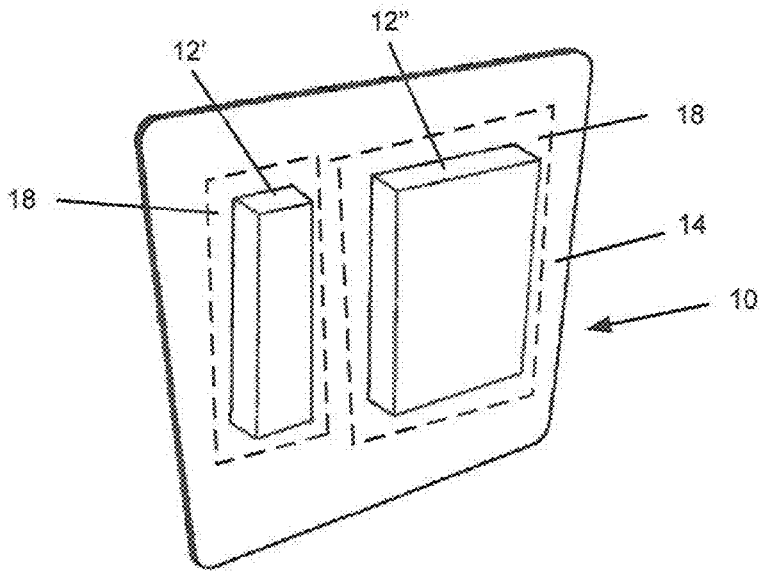
FIG. 5 is a front perspective view showing a fourth exemplary display packaging system in an assembled state.
Figure 6:
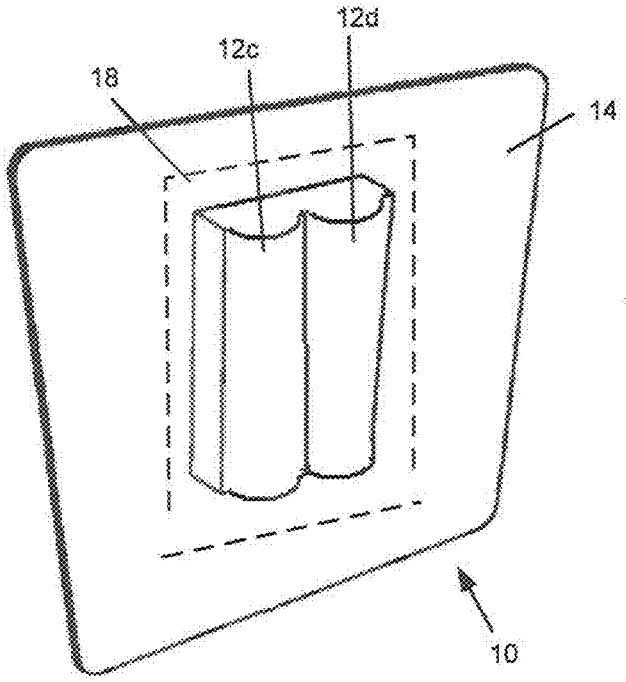
FIG. 6 is a front perspective view showing a fifth exemplary display packaging system in an assembled state.
Figure 7:
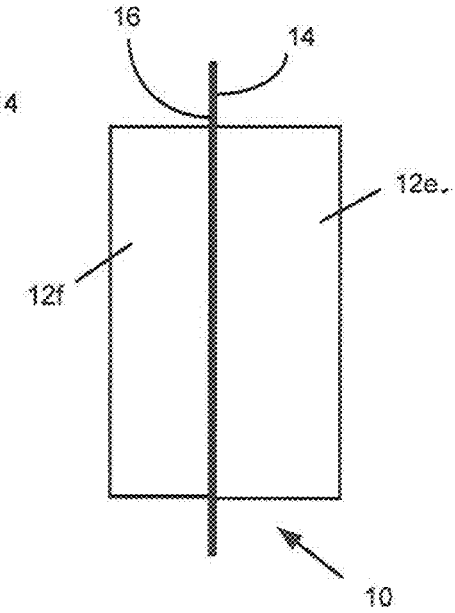
FIG. 7 is a side view showing a sixth exemplary display packaging system in an assembled state.

As further illustrated in FIGS. 1 and 2, one or both of the front panel 14 and the rear panel 16 is fitted with an opening or window 22 sufficient in shape and size to allow at least the product holding chamber of the blister cavity 12 to pass through or be visible through (individually and collectively referred to as being "visible") the opening 22 while allowing the sealing flange 18 to rest flush against an adhesive coated, interior side of the panels. By way of additional example, FIG. 3 illustrates a blister cavity 12 that is positioned adjacent to a bottom side of the front panel 14 and the rear panel 16. In the arrangement illustrated in FIG. 3, the sealing flange(s) 18 do not surround the blister cavity 12, e.g., the bottom side of the blister cavity 12 does not include any scaling flange(s) 18, and the window provided to one or both of the front panel 14 and the rear panel by which item(s) contained within the blister cavity 12 are visible is similarly not entirely surrounded by panel material, e.g., the assembly can be free standing upon the base of the blister cavity 12. By way of further example, FIG. 4 illustrates an assembly that utilizes a single blister cavity having two distinct and separated blister cavity chambers 12*a*/12*b* and a panel assembly wherein one or both of the front panel 14 and the rear panel are provided with complimentary, distinct and separated windows by which item(s) contained within the blister cavity chambers 12*a*/12*b* are visible. By way of still further example, FIG. 5 illustrates an assembly that utilizes two separate and distinct blister cavities 12'/12" and a panel assembly wherein one or both of the front panel 14 and the rear panel are provided with complimentary, distinct and separated windows by which item(s) contained within the blister cavities 12'/12" are visible. By way of yet further example, FIG. 6 illustrates an assembly that utilizes a single blister cavity having two adjoined blister cavity chambers 12*c*/12*d* and a panel assembly wherein one or both of the front panel 14 and the rear panel are provided with a complimentary window by which item(s) contained within the chambers 12*c*/12*d* of the blister cavity are visible. As still further illustrated in exemplary FIG. 7, the blister cavity may be comprised of a fold-over type blister cavity assembly comprised of blister cavity halves 12*e*/12*f* where, once folded together and attached between the panels 14/16, the blister cavity halves 12*e*/12*f* will protrude from complimentary windows formed in each of the panels 14/16. It will be understood that the assembly illustrated in FIG. 7 need not use a fold-over type blister cavity assembly but could instead use two distinct blister cavity halves that are positioned adjacent to one another and then assembled as shown. It is also to be understood that various combinations of these illustrated examples can be assembled without departing from the scope of the invention described and claimed.

To assemble the display packaging system 10, one of the front panel 14 and rear panel 16 is fed or placed onto a blister packaging machine with the adhesive coated side of the placed panel facing upward. The blister cavity 12 is then fed or placed onto the blister packaging machine such that the sealing flange 18 of the blister cavity 12 rests upon the upwardly facing adhesive coated side of the already placed panel. Because the molded product holding chamber of the blister cavity 12 is typically passed through and nested into the opening 22 of the already placed panel, at this point in the process it would be appropriate to feed or to place any product or items to be packaged into the formed product holding chamber of the blister cavity 12. The adhesive side of the remaining one of the front panel 12 and rear panel 14 is then fed or placed over the first placed panel such that the front panel 12 and rear panel 14 will be oriented adhesive side to adhesive side with the sealing flange 18 of the blister cavity 12 being sandwiched in between the two panels. These components, now assembled, may now be placed in a sealing apparatus or indexed under a heated platen of the blister packaging machine. It will be understood that feeding and/or placing the components in the manner described above refers to the steps being performed manually and/or automatically by the blister packaging machine.

Turning to the sealing operation, it is preferred that the equipment that is to perform the sealing operation be fitted with a tooling profile that allows the heat and pressure of the sealing apparatus to be focused and located only in particular parts of the assemblage. Specifically, it is desired that the heat and pressure of the sealing apparatus be focused and located in alignment with and within the apertures 20 of the sealing flange 18 of the blister cavity 12 inside the width of the sealing flange and in selected areas outside of the width of the sealing flange 18, i.e., the footprint of the blister cavity 12, where necessary to ensure that the panel 14 and the panel 16 are securely sealed together. Thus, a seal is applied in only those areas of the two mating panels 14 and 16 where no sealing flange 18 material is disposed between the two panels 14 and 16 and the seal will accordingly include those areas of the two panels 14 and 16 between which is disposed the apertures 20 of the sealing flange 18. The avoidance of adhesion of any portion of the panels 14 and 16 to the sealing flange thus allows the blister cavity 12 and the panels 14 and 16 to be cleanly separated when the packaging system 10 is later opened which, in turn, allows the components of the packaging system 10 to be readily recycled.

While specific embodiments of a display packaging system have been described in detail, it will, be appreciated by those skilled in the art that various modifications and alternatives to those details could be developed in light of the overall teachings of this disclosure. By way of example only, the front panel and the rear panel need not be separate panels but may be a single panel where one panel is placed over the other panel as a result of the single panel being folded with the blister cavity sandwiched there between. Accordingly, the particular arrangements disclosed are meant to be illustrative only and not limiting as to the scope of the invention which is to be given the full breadth of the appended claims and any equivalents thereof.

What is claimed is:

1. A display packaging system, comprising:

a front panel having an interior surface;

a rear panel having an interior surface; and a blister cavity comprising at least one product holding chamber configured to receive at least one product and a sealing flange, extending outwardly from the at least one product holding chamber, having a series of apertures;

wherein the sealing flange is sandwiched between the interior surface of the front panel and the interior surface of the rear panel and respect portions of the interior surface of the front panel and the interior surface of the rear panel are adhered only to each other which respective portions includes portions of the interior surface of the front panel and portions of the interior surface of the rear panel that are disposed on opposite sides of the series of apertures of the sealing flange; and wherein the blister cavity outwardly protrudes from at least one window formed in the front panel and the rear panel.

2. The display packaging system as recited in claim 1, wherein the blister cavity comprises a pair of blister cavity halves wherein the first blister cavity halve outwardly protrudes from a window formed in the front panel and the second blister cavity halve outwardly protrudes from a window formed in the rear panel.

3. The display packaging system as recited in claim 2, wherein the blister cavity halves are adjoined and folded together to form the blister cavity.

4. The display packaging system as recited in claim 1, wherein the sealing flange extends about a periphery of the blister cavity.

5. The display packing system as recited in claim 1, wherein the sealing flange extends about a portion of a periphery of the blister cavity.

6. The display packaging system as recited in claim 5, wherein a bottom surface of the blister cavity is adjacent to a bottom of the front panel and the rear panel and the display packing system is able to stand upon the bottom surface of the blister cavity.

7. A display packaging system, comprising:

a front panel having an interior surface;

a rear panel having an interior surface; and a blister cavity comprising at least two product holding chambers each configured to receive at least one product and a sealing flange, extending outwardly from the at least two product holding chambers, having a series of apertures;

wherein the sealing flange is sandwiched between the interior surface of the front panel and the interior surface of the rear panel and respect portions of the interior surface of the front panel and the interior surface of the rear panel are adhered only to each other which respective portions includes portions of the interior surface of the front panel and portions of the interior surface of the rear panel that are disposed on opposite sides of the series of apertures of the sealing flange.

8. The display packaging system as recited in claim 7, wherein the at least two product holding chambers of the blister cavity are adjoined.

9. The display packaging system as recited in claim 8, wherein the blister cavity outwardly protrudes from a window formed in at least one of the front panel and the rear panel.

10. The display packaging system as recited in claim 7, wherein the at least two product holding chambers of the blister cavity are spaced apart.

11. The display packaging system as recited in claim 10, wherein the at least two product holding chambers of the blister cavity outwardly protrude from a corresponding number of spaced windows formed in at least one of the front panel and the rear panel.

12. A display packaging system, comprising:

a front panel having an interior surface;

a rear panel having an interior surface; and at least two blister cavities each comprising at least one product holding chamber configured to receive at least one product and a sealing flange, extending outwardly from the at least one product holding chamber, having a series of apertures;

wherein the sealing flanges are sandwiched between the interior surface of the front panel and the interior surface of the rear panel and respect portions of the interior surface of the front panel and the interior surface of the rear panel are adhered only to each other which respective portions includes portions of the interior surface of the front panel and portions of the interior surface of the rear panel that are disposed on opposite sides of the series of apertures of the sealing flanges.

13. The display packaging system as recited in claim 12 wherein the product holding chamber of each of the at least two blister cavities outwardly protrude from one of a corresponding number of spaced windows formed in at least one of the front panel and the rear panel.

14. The display packaging system as recited in claim 1, wherein at least one of the front panel and the second panel comprises a corrugated material.

15. The display packaging system as recited in claim 7, wherein at least one of the front panel and the second panel comprises a corrugated material.

16. The display packaging system as recited in claim 12, wherein at least one of the front panel and the second panel comprises a corrugated material.

17. The display packaging system as recited in claim 1, wherein the apertures comprise at least one formed slot.

18. The display packaging system as recited in claim 7, wherein the apertures comprise at least one formed slot.

19. The display packaging system as recited in claim 12, wherein the apertures comprise at least one formed slot.

* * * * *